US009685739B2

(12) United States Patent
Chen et al.

(10) Patent No.: US 9,685,739 B2
(45) Date of Patent: Jun. 20, 2017

(54) ELECTRICAL RECEPTACLE CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Xiao-Juan Qi, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/263,729

(22) Filed: Sep. 13, 2016

(65) Prior Publication Data

US 2017/0085037 A1 Mar. 23, 2017

(30) Foreign Application Priority Data

Sep. 17, 2015 (CN) ..... 2015 1 0592656

(51) Int. Cl.

| | |
|---|---|
| ***H01R 13/6585*** | (2011.01) |
| ***H01R 24/62*** | (2011.01) |
| ***H01R 13/08*** | (2006.01) |
| ***H01R 13/6461*** | (2011.01) |
| *H01R 107/00* | (2006.01) |

(52) U.S. Cl.

CPC ..... *H01R 13/6585* (2013.01); *H01R 13/08* (2013.01); *H01R 13/6461* (2013.01); *H01R 24/62* (2013.01); *H01R 2107/00* (2013.01)

(58) Field of Classification Search

USPC ... 439/607.05, 607.01, 374, 218, 607.28, 78

See application file for complete search history.

(56) References Cited

U.S. PATENT DOCUMENTS

| | | | | |
|---|---|---|---|---|
| 8,801,462 | B2 * | 8/2014 | Tsai | H01R 12/724 439/607.01 |
| 9,318,856 | B2 * | 4/2016 | MacDougall | H01R 13/6581 |
| 9,337,588 | B2 * | 5/2016 | Chang | H01R 13/6594 |
| 9,350,121 | B2 * | 5/2016 | Ju | H01R 13/6585 |
| 9,350,126 | B2 * | 5/2016 | Little | H01R 24/60 |
| 9,356,400 | B2 * | 5/2016 | Little | H01R 4/023 |
| 9,379,499 | B2 * | 6/2016 | Miyoshi | H01R 24/60 |
| 9,525,227 | B2 * | 12/2016 | Little | H01R 13/6273 |
| 9,564,716 | B2 * | 2/2017 | Kao | H01R 13/6586 |
| 9,590,336 | B2 * | 3/2017 | Tsai | H01R 12/75 |
| 2010/0267261 | A1 * | 10/2010 | Lin | H01R 13/6461 439/218 |

(Continued)

*Primary Examiner* — Alexander Gilman

(74) *Attorney, Agent, or Firm* — Muncy, Geissler, Olds & Lowe, P.C.

(57) ABSTRACT

An electrical receptacle connector includes a mount member received in a metallic shell. A tongue portion is integrally formed to a front portion of the mount member. A plurality of first receptacle terminals, a plurality of second receptacle terminals, and a grounding plate are held in the mount member and the tongue portion. The front ends of the first and second receptacle terminals are respectively inserted into two opposite surfaces of the tongue portion. Therefore, the first receptacle terminals, the second receptacle terminals, and the grounding plate are positioned with each other securely. Accordingly, when the connector is impacted by an external force, the components of the connector would not be detached from each other easily.

10 Claims, 8 Drawing Sheets

(56) References Cited

U.S. PATENT DOCUMENTS

| | | | | |
|---|---|---|---|---|
| 2013/0344739 | A1* | 12/2013 | Shih | H01R 13/658<br>439/607.28 |
| 2014/0113481 | A1* | 4/2014 | Little | H01R 13/64<br>439/374 |
| 2014/0194005 | A1* | 7/2014 | Little | H01R 13/6585<br>439/607.28 |
| 2015/0171574 | A1* | 6/2015 | Little | H01R 24/60<br>439/78 |
| 2016/0156136 | A1* | 6/2016 | Kao | H01R 13/6585<br>439/607.05 |

* cited by examiner

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 8

ELECTRICAL RECEPTACLE CONNECTOR

CROSS-REFERENCES TO RELATED APPLICATIONS

This non-provisional application claims priority under 35 U.S.C. §119(a) on Patent Application No. 201510592656.1 filed in China, P.R.C. on Sep. 17, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. Normally, the plastic core of a conventional USB type-C electrical receptacle connector is an assembly of several plastic components, and the upper receptacle terminals and the lower receptacle terminals are respectively assembled with the plastic components.

SUMMARY OF THE INVENTION

The plastic components are combined with each other merely by assembling means; once the plastic components cannot fit with each other properly, the structural strength of the assembly is reduced and some of the plastic components may even detach off the assembly. Moreover, because contact portions of the receptacle terminals are not positioned by a tongue portion of the connector, the receptacle terminals may be detached from the plastic core during the operation. Therefore, how to solve the aforementioned problem is an issue.

In view of this, an embodiment of the instant disclosure provides an electrical receptacle connector. The electrical receptacle connector comprises a metallic shell, a mount member, a plurality of first receptacle terminals, a plurality of second receptacle terminals, and a grounding plate. The metallic shell comprises a receptacle cavity. The mount member is received in the receptacle cavity. A tongue portion is integrally formed to a front portion of mount member. The first receptacle terminals are on a first side of the mount member. The first receptacle terminals comprise a plurality of first flat contact portions and a plurality of first-row of first horizontal tail portions. Each of the first-row of first horizontal tail portions is extending from one end of the corresponding first flat contact portion. The first flat contact portions are on a first surface of the tongue portion. A front portion of each of the first flat contact portions is held in the first surface of the tongue portion, and the first-row of first horizontal tail portions are protruding from the mount member. The second receptacle terminals are on a second side of the mount member. The second receptacle terminals comprise a plurality of second flat contact portions, a plurality of first-row of second horizontal tail portions, and a plurality of second-row of vertical tail portions. The first-row of second horizontal tail portions and the second-row of vertical tail portions are extending from one ends of the respective second flat contact portions. The second flat contact portions are on a second surface of the tongue portion. A front end of each of the second flat contact portions is held in the second surface of the tongue portion. The first-row of second horizontal tail portions and the second-row of vertical tail portions are protruding from the mount member. The first-row of first horizontal tail portions and the first-row of second horizontal tail portions are aligned along a same horizontal line. The first-row of second horizontal tail portions are arranged at two outermost sides of the first-row of first horizontal tail portions. The grounding plate is in the mount member. A front portion of the grounding plate is extending into the tongue portion and between the first flat contact portions and the second flat contact portions. Two sides of the grounding plate are protruding from two lateral surfaces of the tongue portion.

In some embodiments, the first receptacle terminals comprise a plurality of first body portions and a plurality of first bending portions. The first body portions are between the respective first flat contact portions and the respective first-row of first horizontal tail portions and held in the mount member. The first bending portions are between the respective first flat contact portions and the respective first body portions and between the respective first body portions and the respective first-row of first horizontal tail portions.

In some embodiments, the second receptacle terminals comprise a plurality of second body portions and a plurality of second bending portions. Some of the second body portions are between the respective second flat contact portions and the respective first-row of second horizontal tail portions, rest of the second body portions are between the respective second flat contact portions and the respective second-row of vertical tail portions, and the second body portions are held in the mount member. The second bending portions are between the respective second flat contact portions and the respective second body portions, between the respective second body portions and the respective first-row of second horizontal tail portions, and between the respective body portions and the respective second-row of vertical tail portions.

In some embodiments, the second receptacle terminals comprise a plurality of slant portions formed on the respective second body portions for adjusting distances between the first-row of second horizontal tail portions.

In some embodiments, the grounding plate comprises a plate body and a plurality of legs. The plate body is between the first flat contact portions and the second flat contact portions. The legs are outward extending from two sides of a rear of the plate body and arranged at two outermost sides of the first-row of second horizontal tail portions. In addition, the grounding plate comprises a plurality of through holes on the plate body.

In some embodiments, a positioning block is assembled on the grounding plate. The positioning block comprises a plurality of protrusions on an upper surface and a lower surface of the grounding plate for abutting against front portions of the first receptacle terminals and front portions of the second receptacle terminals, respectively.

In some embodiments, the first receptacle terminals comprise a plurality of first ground terminals, a plurality of pairs of first high speed signal terminals, a plurality of first power terminals, a first function detection terminal, a pair of first low speed signal terminals, and a first supplement terminal.

In some embodiments, the second receptacle terminals comprising the second-row of vertical tail portions comprise a pair of second low speed signal terminals, a second supplement terminal, a second power terminal, another second power terminal, and a second function detection terminal, the second receptacle terminals comprising the first-row of second horizontal tail portions comprise a second ground terminals and a pair of second high speed signal terminals.

Based on the above, the first receptacle terminals, the second receptacle terminals, and the grounding plate are arranged together, and then insert molding with the mount member and the tongue portion, so that the mount member and the tongue portion are integrally formed and covering the grounding plate. The front ends of the flat contact portions of the first receptacle terminals are inserted into one surface of the tongue portion, and the front ends of the flat contact portions of the second receptacle terminals are inserted into the other surface of the tongue portion. Therefore, the first receptacle terminals, the second receptacle terminals, and the grounding plate are positioned with each other securely. Accordingly, when the connector is impacted by an external force, the components of the connector would not be detached from each other easily. Moreover, the front portions of the first and second receptacle terminals are covered by the tongue portion. Accordingly, the flat contact portions of the electrical receptacle connector would not detach off the tongue portion after the connector is used for a period.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 8 illustrates a schematic configuration diagram of the receptacle terminals of the electrical receptacle connector.

DETAILED DESCRIPTION

Figure 1:
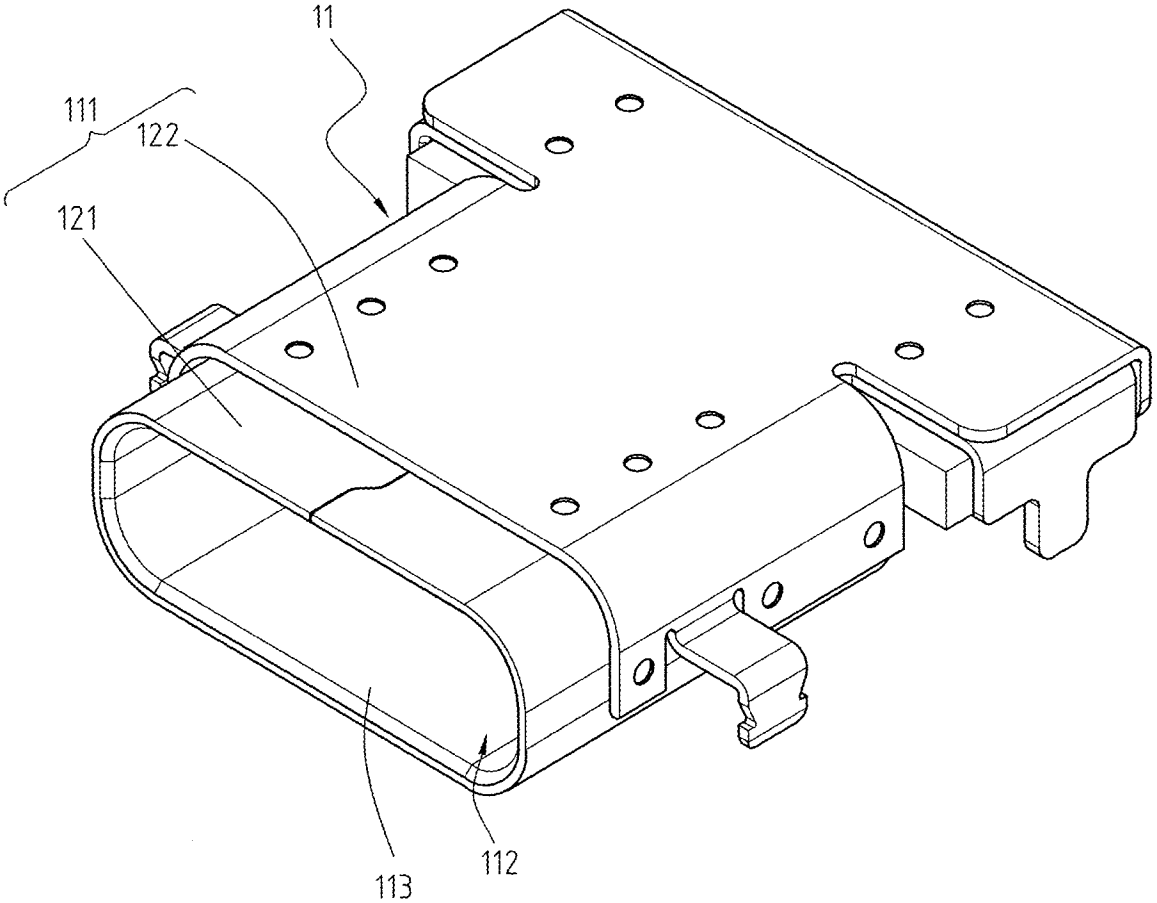
FIG. 1 illustrates a perspective view of an electrical receptacle connector according to a first embodiment of the instant disclosure.
Figure 2:
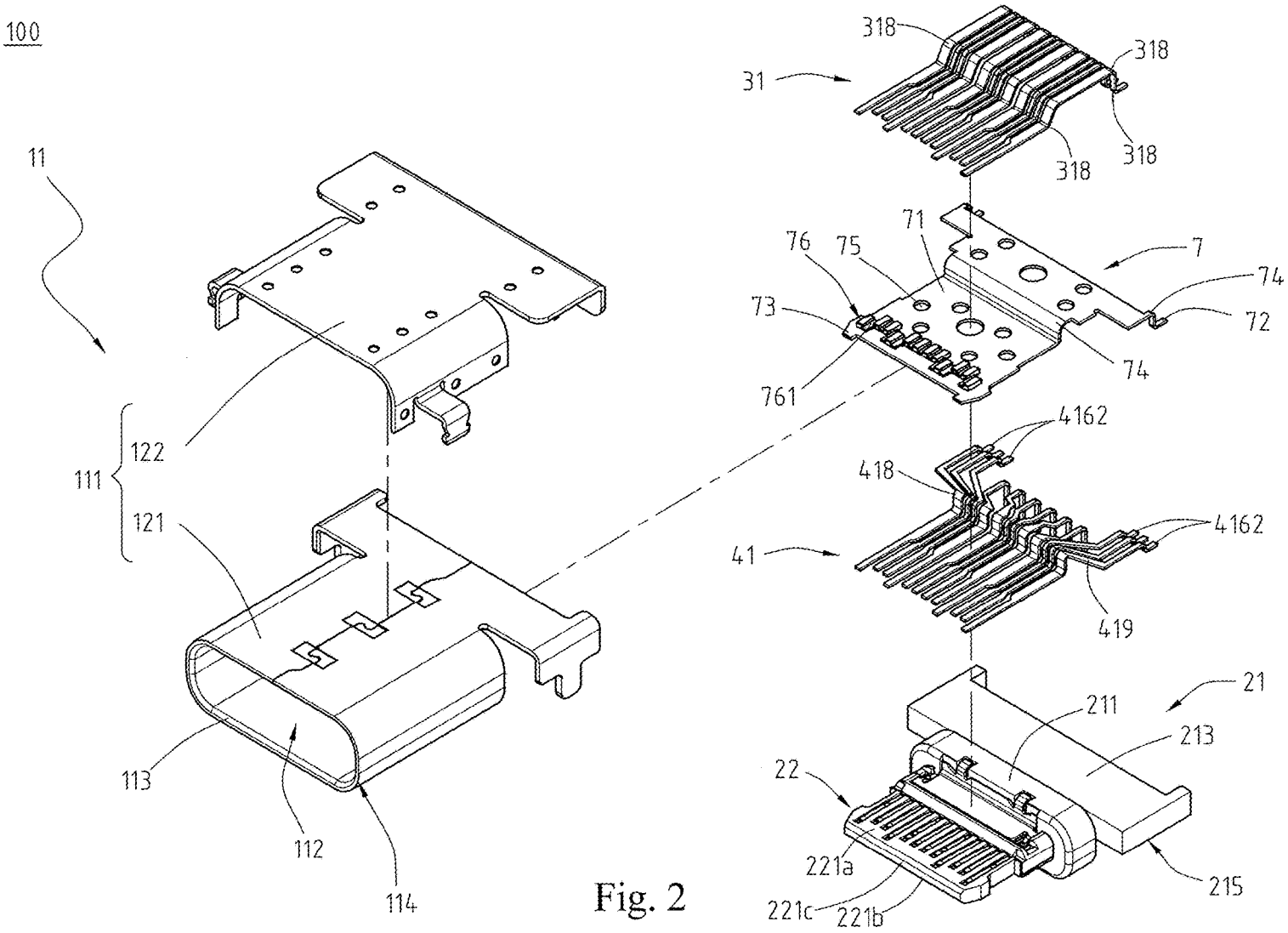
FIG. 2 illustrates an exploded view of the electrical receptacle connector of the first embodiment.

Please refer to FIGS. 1 and 2, which illustrate an electrical receptacle connector 100 of a first embodiment of the instant disclosure. FIG. 1 illustrates a perspective view of the electrical receptacle connector 100. FIG. 2 illustrates an exploded view of the electrical receptacle connector 100. In this embodiment, the electrical receptacle connector 100 is assembled with a circuit board by sinking technique. That is, one side of the circuit board is cut to form a crack, and the electrical receptacle connector 100 is positioned at the crack and extending toward the side portion of the circuit board. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, a mount member 21, a plurality of first receptacle terminals 31, a plurality of second receptacle terminals 41, and a grounding plate 7.

Please refer to FIGS. 1 and 2. In this embodiment, the metallic shell 11 is a hollowed shell, and the metallic shell 11 comprises a shell body 111 and a receptacle cavity 112 formed in the shell body 111. In this embodiment, the metallic shell 11 may be a tubular member 114 and the receptacle cavity 112 is formed in the tubular member 114. The metallic shell 11 may be formed by a multi-piece member; in such embodiment, the metallic shell 11 further comprises an inner shell 121 and a cover plate 122, the inner shell 11 is a hollowed shell and encloses the mount member 21. The cover plate 122 may be a semi-tubular member having a U-shape cross section, and the semi-tubular member covers the top and the two sides of the inner shell 121, but embodiments are not limited thereto. In some embodiments, the cover plate 122 may be a hollowed shell and encloses the inner shell 121. In addition, an insertion opening 113 with oblong shaped is formed on one side of the metallic shell 11, and the insertion opening 113 communicates with the receptacle cavity 112.

Figure 4:
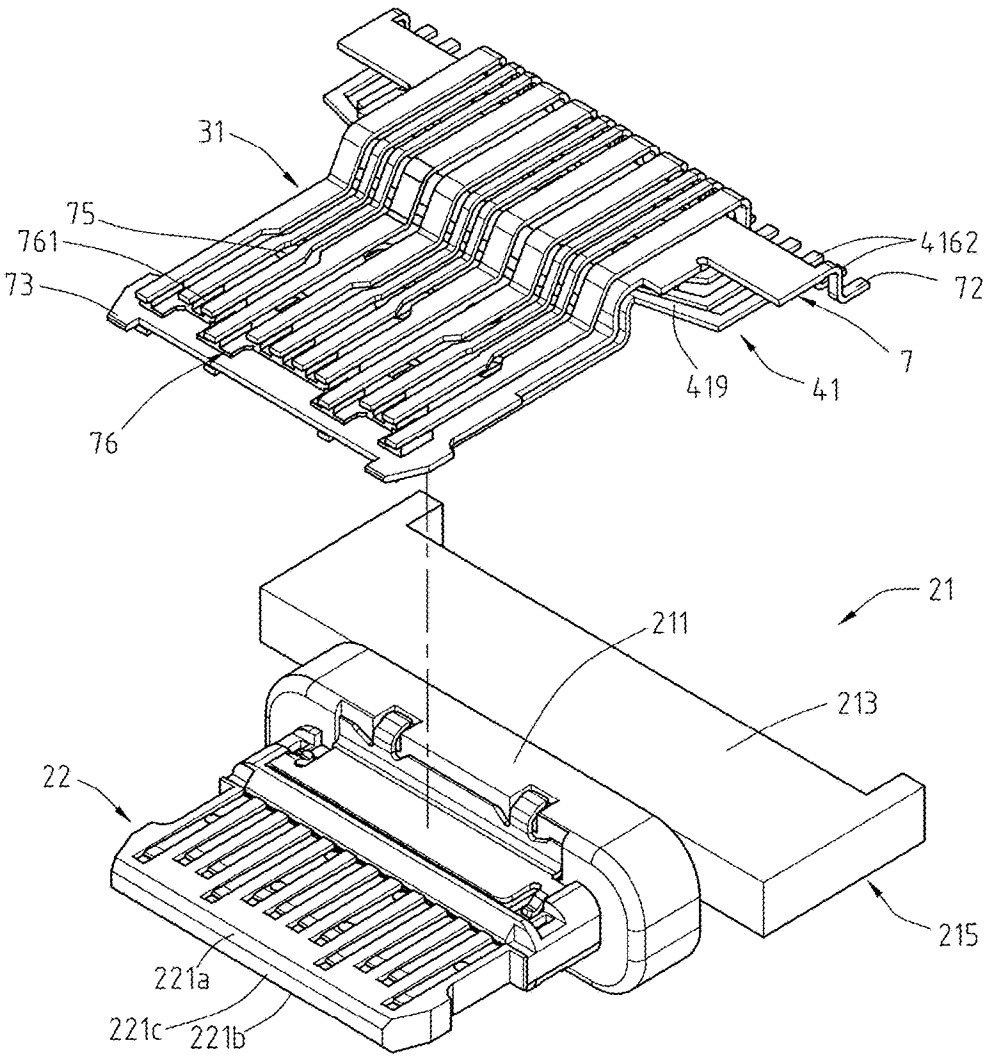
FIG. 4 illustrates a schematic view (1) showing the assembling of the electrical receptacle connector of the first embodiment.
Figure 6:
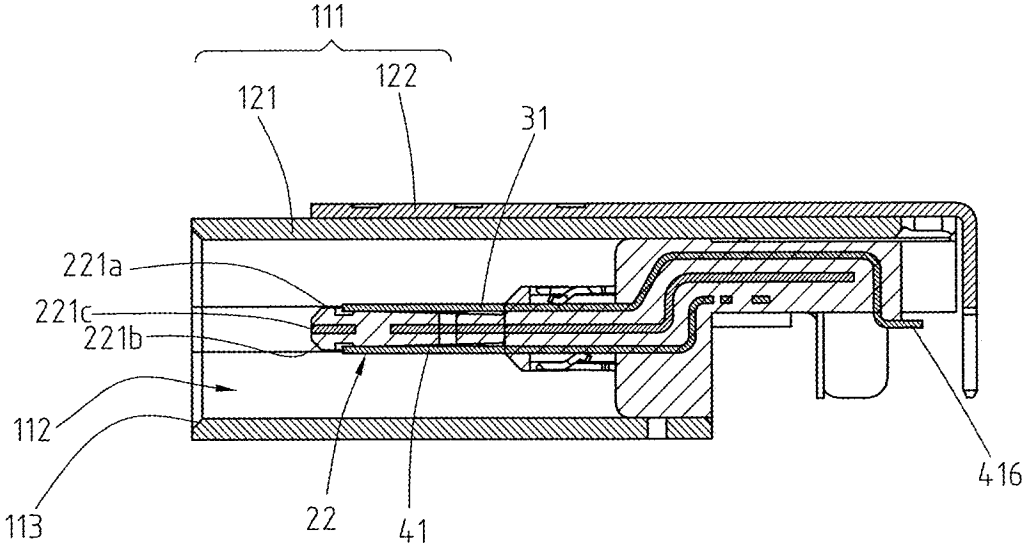
FIG. 6 illustrates a schematic view (3) showing the assembling of the electrical receptacle connector of the first embodiment.

Please refer to FIGS. 2, 4, and 6. In this embodiment, the mount member 21 is received in the receptacle cavity 112 of the metallic shell 11. A tongue portion 22 is integrally formed to a front portion of the mount member 21, and the tongue portion 22 and the mount member 21 have a same texture. Since the mount member 21 and the tongue portion 22 are formed by insert-molding techniques, the mount member 21 and the tongue portion 22 are formed by solidifying plastic materials in liquid state. Therefore, the texture of the mount member 21 is consistent with that of the tongue portion 22. For example, if the surface of the mount member 21 is smooth, the surface of the tongue portion 22 is smooth as well; while if the surface of the mount member 21 is rough, the surface of the tongue portion 22 is rough as well. In this embodiment, the mount member 21 comprises a base portion 211, an extension member 213, and an assembling space 215. The tongue portion 22 is extending from one of two ends of the base portion 211, and the extension member 213 is outward extending from a top portion of the other end of the base portion 211. The assembling space 215 is formed below the extension member 213 for assembling with a circuit board. In addition, the tongue portion 22 has two opposite surfaces, one is a first surface 221*a* (i.e., the upper surface), and the other is a second surface 221*b* (i.e., the lower surface). In addition, the front lateral surface 221*c* of the tongue portion 22 is connected the first surface 221*a* with the second surface 221*b* and is close to the insertion opening 113. In other words, the front lateral surface 221*c* is near to the insertion opening 113 and perpendicularly connected to the first surface 221*a* and the second surface 221*b*, respectively.

Please refer to FIGS. 2, 3, 6, and 7. The first receptacle terminals 31 are on the mount member 21. Each of the first receptacle terminals 31 comprises a flat contact portion 315, a body portion 317, a first-row of first horizontal tail portion 316, and a plurality of first bending portions 318. The body portions 317 are held in the mount member 21. The body portions 317 are between the respective flat contact portions 315 and the respective first-row of first horizontal tail portions 316. In other words, each of the flat contact portions 315 is extending forward from the corresponding body portion 317 in the rear-to-front direction and on the first surface 221*a* (or the second surface 221*b*) of the tongue portion 22, and each of the first-row of first horizontal tail portions 316 is extending backward from the corresponding body portion 317 in the front-to-rear direction and protruding from the rear portion of the mount member 21. Moreover, the first bending portions 318 are between the flat contact portions 315 and the body portions 317 and between the body portions 317 and the first-row of first horizontal tail portions 316. In this embodiment, twelve first receptacle terminals 31 are bent to form first bending portions 318 by four bending procedures, so that each of the flat contact portions 315 and the corresponding body portion 317 are aligned on different horizontal lines. The body portions 317 are positioned with the extension member 213. The first-row of first horizontal tail portions 316 are bent to form flat legs, which can be mounted or soldered on the surface of a printed circuit board by using surface mount technology. Accordingly, the first receptacle terminals 31 have great orthogonality and flatness.

Figure 3:
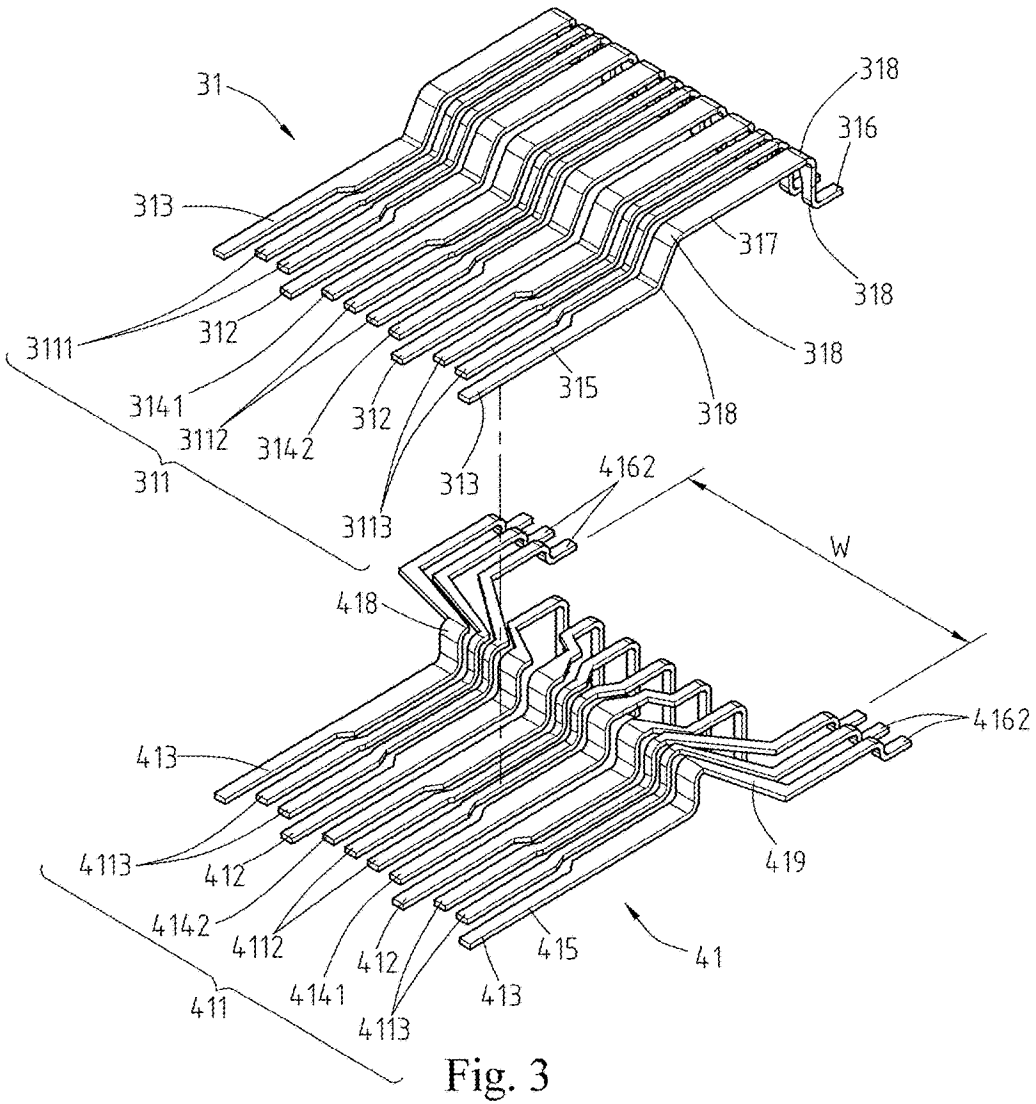
FIG. 3 illustrates a perspective view of first receptacle terminals and second receptacle terminals of the electrical receptacle connector.
Figure 7:
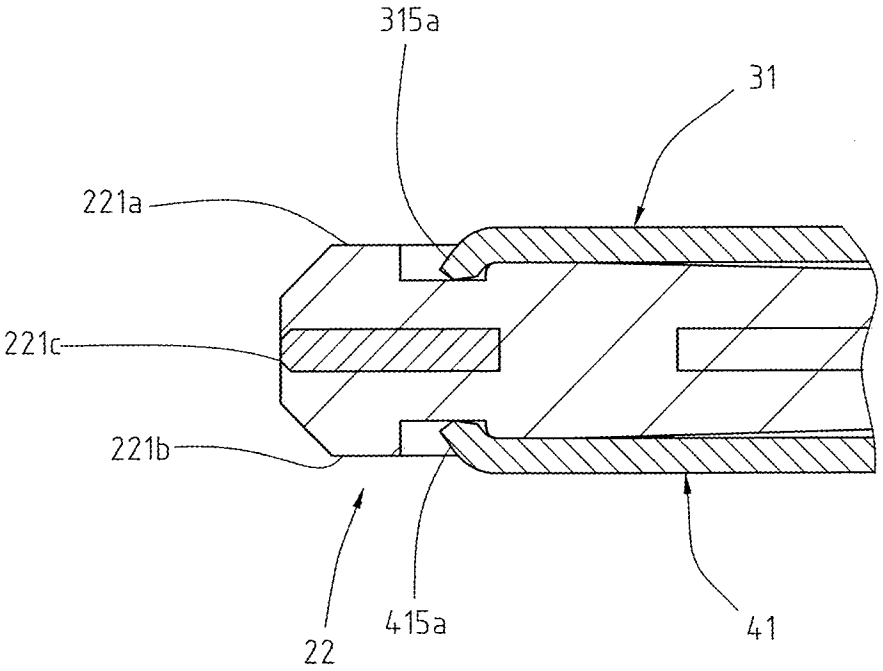
FIG. 7 illustrates a partial enlarged sectional view of the electrical receptacle connector of the first embodiment.

Please refer to FIGS. 3, 6, and 7. In this embodiment, a front end 315*a* of each of the first receptacle terminals 31 is a hook-like structure extending from a front portion of the corresponding flat contact portion 315. For the same first receptacle terminal 31, the front end 315*a* thereof is opposite to the first-row of first horizontal tail portion 316 thereof. Additionally, after the tongue portion 22 is made, the front ends 315*a* of the first receptacle terminals 31 are covered by the tongue portion 22, but embodiments are not limited thereto. In some embodiments, the front ends 315*a* of the first receptacle terminals 31 are inserted to the tongue portion 22. Accordingly, the flat contact portions 315 can be positioned onto the first surface 221*a* of the tongue portion 22 firmly. Hence, the flat contact portions 315 of the electrical receptacle connector 100 would not detach off the first surface 221*a* of the tongue portion 22 after the connector is used for a period.

Please refer to FIGS. 2, 3, 6, and 7. Each of the second receptacle terminals 41 are on the mount member 21. Each of the second receptacle terminals 41 comprises a flat contact portion 415, a body portion 417, a first-row of second horizontal tail portion 4162 (or a second-row of vertical tail portion 4161), and a plurality of second bending portions 418. The body portions 417 are held in the mount member 21. The body portions 417 are between the respective flat contact portions 415 and the respective first-row second flat tail portions 4162 or between the respective flat contact portions 415 and the respective second-row of vertical tail portions 4161. In other words, each of the flat contact portions 415 is extending forward from the corresponding body portion 417 in the rear-to-front direction and on the second surface 221*b* (or the first surface 221*a*) of the tongue portion 22, each of the first-row of second horizontal tail portions 4162 is extending backward from the corresponding body portion 417 in the front-to-rear direction and protruding from the rear portion of the mount member 21, and each of the second-row of vertical tail portions 4161 is extending backward from the corresponding body portion 417 in the front-to-rear direction and protruding from the rear portion of the mount member 21. The second bending portions 418 are between the flat contact portions 415 and the body portions 417, between the body portions 417 and the first-row of second horizontal tail portions 4162, and between the body portions 417 and the second-row of vertical tail portions 4161.

Figure 5:
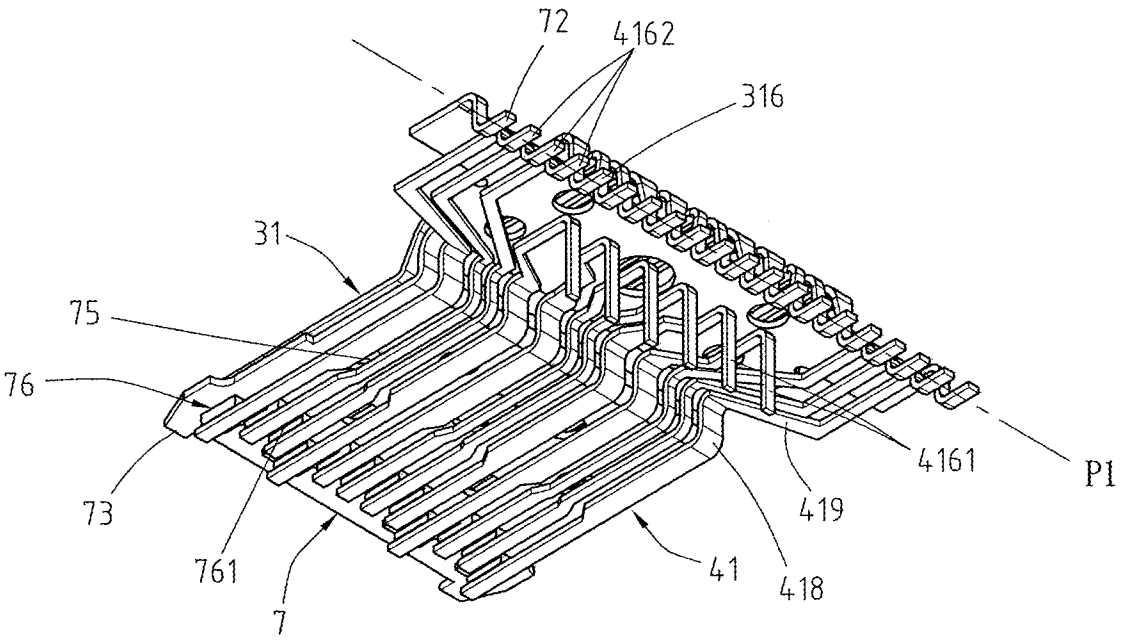
FIG. 5 illustrates a schematic view (2) showing the assembling of the electrical receptacle connector of the first embodiment.

Please refer to FIGS. 3, 5, and 6. Twelve second receptacle terminals 41 are bent and respective form six terminals comprising the second-row of vertical tail portions 4161 (i.e., vertical legs, legs which are to be soldered with a circuit board by through-hole technology) and six terminals comprising the first-row of second horizontal tail portions 4162 (i.e., horizontal or flat legs, legs which are to be soldered with a circuit board by surface mount technology). The six terminals comprising the second-row of vertical tail portions 4161 are a pair of second low-speed signal terminals 4112 (D+−, differential terminals for low-speed signal transmission), a second supplement terminal 4142 (SBU2, a terminal can be reserved for other purposes), a power terminal 412 (Power/VBUS), another power terminal 412 (Power/VBUS), and a second function detection terminal 4141 (CC2, a terminal for inserting orientation detection of the connector and for cable recognition). The six terminals comprising the first-row of second horizontal tail portions 4162 are a ground terminal 413 (Gnd), a first pair of second high-speed signal terminals 4111 (TX2+−, differential terminals for high-speed signal transmission), a second pair of second high-speed signal terminals 4113 (RX1+−, differential terminals for high-speed signal transmission), and another ground terminal 413 (Gnd).

Please refer to FIGS. 3, 5, and 6. The flat contact portions 415 and the body portions 417 are aligned on different horizontal lines. The body portions 417 are positioned with the extension member 213. The leftmost three and the rightmost three second receptacle terminals 41 are bent to form the first-row of second horizontal tail portions 4162 (flat or horizontal legs) by four bending procedures. The first-row of second horizontal tail portions 4162 are arranged at two outermost sides of the first-row of first horizontal tail portions 316, and the first-row of first horizontal tail portions 316 and the first-row of second horizontal tail portions 4162 are soldered onto a circuit board. In other words, the first-row of second horizontal tail portions 4162 and the second-row of vertical tail portions 4161 are aligned to different positions of the mount member 21; specifically, the first-row of second horizontal tail portions 4162 are arranged at the rear portion of the mount member 21, the second-row of vertical tail portions 4161 are approximately arranged at the middle portion of the bottom of the mount member 21, and the first-row of second horizontal tail portions 4162 are beyond the second-row of vertical tail portions 4161, as shown in FIG. 3. The first-row of second horizontal tail portions 4162 and the second-row of vertical tail portions 4161 are aligned on a same horizontal line P1. In this embodiment, the second receptacle terminals 41 comprise a plurality of slant portions 419 formed on the respective body portions 417 for adjusting distances W between the first-row of second horizontal tail portions 4162; i.e., the second receptacle terminals 31 comprising the first-row of second horizontal tail portions 4162 comprises the slant portions 419. The middle six terminals of the twelve second receptacle terminals 41 are bent to form the second-row vertical tail portions 4161 (vertical legs) by three bending procedures. Accordingly, the second receptacle terminals 41 have great orthogonality and flatness.

Please refer to FIGS. 6 and 7. In this embodiment, a front end 415*a* of each of the second receptacle terminals 41 is to form a hook-like structure extending from a front portion of the corresponding flat contact portion 415. For the same second receptacle terminal 41, the front end 415*a* thereof is opposite to the first-row of second horizontal tail portion 4162 thereof (or the second-row of vertical tail portion 4161 thereof). Additionally, after the tongue portion 22 is made, the front ends 415*a* of the second receptacle terminals 41 are covered by the tongue portion 22, but embodiments are not limited thereto. In some embodiments, the front ends 415*a* of the second receptacle terminals 41 are inserted to the tongue portion 22. Accordingly, the flat contact portions 415 can be positioned onto the second surface 221*b* of the tongue portion 22 firmly. Hence, the flat contact portions 415 of the electrical receptacle connector 100 would not detach off the second surface 221*b* of the tongue portion 22 after the connector is used for a period.

In this embodiment, the first receptacle terminals 31, the second receptacle terminals 41, and the grounding plate 7 are fixed in preset locations of a mold by fixtures. A positioning block 76 is assembled on the grounding plate 7. The positioning block 76 comprises a plurality of protrusions 761 on an upper surface and a lower surface of the grounding plate 7 for abutting against front portions of the first receptacle terminals 31 and front portions of the second receptacle terminals 41. Next, the mount member 21 and the tongue portion 22 are integrally formed with each other by insert-molding techniques, and the assembly of the mount member 21 and the tongue portion 22 are formed with the first receptacle terminals 31, the second receptacle terminals 41, and the grounding plate 7 during the insert-molding procedures. Therefore, the mount member 21 and the tongue portion 22 have the same texture and are made by the same material. Moreover, the front ends 315*a* of the flat contact portions 315 are inserted into one of two surfaces of the tongue portion 22, the front ends 415*a* of the flat contact portions 415 are inserted into the other surface of the tongue portion 22, so that the first receptacle terminals 31, the second receptacle terminals 41, the grounding plate 7, the mount member 21, and the tongue portion 22 can be securely positioned with each other. Accordingly, when the connector is impacted by an external force, the components of the connector would not be detached from each other easily.

Please refer to FIGS. 2, 3, and 8. The first receptacle terminals 31 comprise a plurality of first signal terminals 311, power terminals 312, and ground terminals 313. The first signal terminals 31 comprises a plurality of pairs of first high-speed signal terminals 3111/3113 and a pair of first low-speed signal terminals 3112. Referring to FIG. 8, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2, 3, 5, and 7. The first receptacle terminals 31 are held in the mount member 21 and formed as the upper-row terminals of the electrical receptacle connector 100. The first signal terminals 311 are disposed on the tongue portion 22 and transmit first signals (namely, USB 3.0 signals). The first-row of first horizontal tail portions 316 are formed as flat or horizontal legs. In addition, the overall width of the first-row of first horizontal tail portions 316 is equal to the overall width of the body portions 317. Therefore, the first-row of first horizontal tail portion 316 and the body portion 317 of each of the first receptacle terminals 31 are aligned along the same line, and the distance between two adjacent first-row of first horizontal tail portions 316 correspond the distance between two adjacent contacts of the circuit board.

Please refer to FIGS. 3, 5, and 8. The second receptacle terminals 41 comprise a plurality of second signal terminals 411, power terminals 412, and ground terminals 413. The second receptacle terminals 41 comprise a plurality of pairs of second high-speed signal terminals 4111/4113 and a pair of second low-speed signal terminals 4112. Referring to FIG. 8, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 3, 5, and 6. The second receptacle terminals 41 are held in the mount member 21 and formed as the lower-row terminals of the electrical receptacle connector 100. In addition, the flat contact portions 315 are substantially aligned parallel with the flat contact portions 415. The second signal terminals 411 are disposed on the tongue portion 22 and transmit second signals (i.e., USB 3.0 signals). In addition, the first-row of second horizontal tail portions 4162 (flat or horizontal legs), the second-row of vertical tail portions 4161 (vertical legs), and the first-row of first horizontal tail portions 316 are aligned by offsets and separated with each other.

Please refer to FIGS. 2, 4, and 6. The electrical receptacle connector 100 further comprises a grounding plate 7. The grounding plate 7 is in the mount member 21. The grounding plate 7 comprises a plate body 71, a plurality of legs 72, and a plurality of bending portions 74. The plate body 71 is between the first receptacle terminals 31 and the second receptacle terminals 41, i.e., the plate body 71 is held at the mount member 21, and the plate body 71 is between the flat contact portions 315 of the first receptacle terminals 31 and the flat contact portions 415 of the second receptacle terminals 41. Specifically, the plate body 71 may be lengthened and widened, so that the front of the plate body 71 is near to the front lateral surface 221*c* of the tongue portion 22, two sides of the plate body 71 is near to two sides of the tongue portion 22, and the rear of the plate body 71 is near to the rear of the mount member 21. Accordingly, the plate body 71 can be disposed on the tongue portion 22 and the mount member 21, and the structural strength of the tongue portion 22 and the shielding performance of the tongue portion 22 can be improved. Moreover, the grounding plate 7 comprises a plurality of through holes 75 formed on the plate body 71. During the formation of the tongue portion 22, plastic materials in liquid state are flowing from one surface to the other surface of the grounding plate 7 via the through hole 75. When the plastic materials in liquid state are dried and set to form a solid tongue portion 22, the tongue portion 22 and grounding plate 7 are integrally formed with each other.

Please refer to FIGS. 2, 4, and 6. The grounding plate 7 are bent to form the bending portions 74 by four bending procedures, so that the front portion of the grounding plate 7 and the rear portion of the grounding plate 7 are aligned on different horizontal planes. Furthermore, the legs 72 are downward extending from two sides of the rear portion of the plate body 71 and bent to form flat or horizontal legs. The legs 72 are arranged at two outermost sides of the first-row of second horizontal tail portions 4162. The legs 72 and the first-row of second horizontal tail portions 4162 are aligned on the same horizontal line P1. The legs 72 are exposed from the mount member 21 to be in contact with the circuit board. In this embodiment, the crosstalk interference can be reduced by the shielding of the grounding plate 7 when the flat contact portions 315, 415 transmit signals. Furthermore, the structural strength of the tongue portion 22 can be improved by the assembly of the grounding plate 7. In addition, the legs 72 of the grounding plate 7 are exposed from the mount member 21 and in contact with the circuit board for conduction and grounding.

Please refer to FIGS. 2, 4, and 6. The grounding plate 7 further comprises a plurality of hooks 73. The hooks 73 are extending outward from two sides of the front portion of the plate body 71 and protruding out of the front lateral surface 221*c* and two sides of the tongue portion 22. When an electrical plug connector is mated with the electrical receptacle connector 100, elastic pieces at two sides of an insulated housing of the electrical plug connector are engaged with the hooks 73, and the elastic pieces would not wear against the tongue portion 22 of the electrical receptacle connector 100. Hence, the grounding plate 7 can be in contact with the metallic shell 11 for conduction and grounding.

Please refer to FIGS. 2 and 3 to 6. In this embodiment, the first receptacle terminals 31 and the second receptacle terminals 41 are disposed upon the first surface 221*a* and the second surface 221*b* of the tongue portion 22, respectively, and pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180 degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221*a* is facing up, for transmitting first signals. Conversely, the electrical plug connector is inserted into the electrical receptacle connector 100 with a second orientation where the first surface 221*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 2, 3, and 6. In this embodiment, as viewed from the front of the receptacle terminals 31, 41, the position of the first receptacle terminals 31 corresponds to the position of the second receptacle terminals 41. In other words, the positions of the flat contact portions 315 are respectively aligned with the positions of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

Based on the above, the first receptacle terminals, the second receptacle terminals, and the grounding plate are arranged together, and then insert molding with the mount member and the tongue portion, so that the mount member and the tongue portion are integrally formed and covering the grounding plate. The front ends of the flat contact portions of the first receptacle terminals are inserted into one surface of the tongue portion, and the front ends of the flat contact portions of the second receptacle terminals are inserted into the other surface of the tongue portion. Therefore, the first receptacle terminals, the second receptacle terminals, and the grounding plate are positioned with each other securely. Accordingly, when the connector is impacted by an external force, the components of the connector would not be detached from each other easily. Moreover, the front portions of the first and second receptacle terminals are covered by the tongue portion. Accordingly, the flat contact portions of the electrical receptacle connector would not detach off the tongue portion after the connector is used for a period.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a receptacle cavity;

an mount member received in the receptacle cavity of the metallic shell, wherein a tongue portion is integrally formed to a front portion of the mount member;

a plurality of first receptacle terminals on a first side of the mount member, wherein the first receptacle terminals comprise a plurality of first flat contact portions and a plurality of first-row of first horizontal tail portions, each of the first-row of first horizontal tail portions is extending from one end of the corresponding first flat contact portion, the first flat contact portions are on a first surface of the tongue portion, a front portion of each of the first flat contact portions is held in the first surface of the tongue portion, and the first-row of first horizontal tail portions are protruding from the mount member;

a plurality of second receptacle terminals on a second side of the mount member, wherein the second receptacle terminals comprise a plurality of second flat contact portions, a plurality of first-row of second horizontal tail portions, and a plurality of second-row of vertical tail portions, the first-row of second horizontal tail portions and the second-row of vertical tail portions are extending from one ends of the respective second flat contact portions, the second flat contact portions are on a second surface of the tongue portion, a front end of each of the second flat contact portions is held in the second surface of the tongue portion, the first-row of second horizontal tail portions and the second-row of vertical tail portions are protruding from the mount member, the first-row of first horizontal tail portions and the first-row of second horizontal tail portions are aligned along a same horizontal line, the first-row of second horizontal tail portions are arranged at two outmost sides of the first-row of first horizontal tail portions; and a grounding plate in the mount member, wherein a front portion of the grounding plate is extending into the tongue portion and between the first flat contact portions and the second flat contact portions, and two sides of the grounding plate are protruding from two lateral surfaces of the tongue portion.

2. The electrical receptacle connector according to claim 1, wherein the first receptacle terminals comprise a plurality of first body portions and a plurality of first bending portions, the first body portions are between the respective first flat contact portions and the respective first-row of first horizontal tail portions and held in the mount member, the first bending portions are between the respective first flat contact portions and the respective first body portions and between the respective first body portions and the respective first-row of first horizontal tail portions.

3. The electrical receptacle connector according to claim 1, wherein the second receptacle terminals comprise a plurality of second body portions and a plurality of second bending portions, some of the second body portions are between the respective second flat contact portions and the respective first-row of second horizontal tail portions, rest of the second body portions are between the respective second flat contact portions and the respective second-row of vertical tail portions, and the second body portions are held in the mount member, the second bending portions are between the respective second flat contact portions and the respective second body portions, between the respective second body portions and the respective first-row of second horizontal tail portions, and between the respective body portions and the respective second-row of vertical tail portions.

4. The electrical receptacle connector according to claim 1, wherein the second receptacle terminals comprise a plurality of slant portions formed on the respective second body portions for adjusting distances between the first-row of second horizontal tail portions.

5. The electrical receptacle connector according to claim 1, wherein the grounding plate comprises a plate body and a plurality of legs, the plate body is between the first flat contact portions and the second flat contact portions, the legs are outward extending from two sides of a rear of the plate body and arranged at two outermost sides of the first-row of second horizontal tail portions.

6. The electrical receptacle connector according to claim 5, wherein the grounding plate comprises a plurality of through holes on the plate body.

7. The electrical receptacle connector according to claim 5, wherein a positioning block is assembled on the grounding plate, the positioning block comprises a plurality of protrusions on an upper surface and a lower surface of the grounding plate for abutting against front portions of the first receptacle terminals and front portions of the second receptacle terminals, respectively.

8. The electrical receptacle connector according to claim 1, wherein the first receptacle terminals comprise a plurality of first ground terminals, a plurality of pairs of first high speed signal terminals, a plurality of first power terminals, a first function detection terminal, a pair of first low speed signal terminals, and a first supplement terminal.

9. The electrical receptacle connector according to claim 1, wherein the second receptacle terminals comprising the second-row of vertical tail portions comprise a pair of second low speed signal terminals, a second supplement terminal, a second power terminal, another second power terminal, and a second function detection terminal, the second receptacle terminals comprising the first-row of second horizontal tail portions comprise a second ground terminals and a pair of second high speed signal terminals.

10. The electrical receptacle connector according to claim 1, wherein the mount member comprises a base portion, an extension member, and an assembling space, the tongue portion is outward extending from one of two ends of the base portion, the extension member is outward extending from a top portion of the other end of the base portion, and the assembling space is below the extension member.

* * * * *